US010959454B2

(12) United States Patent
Gao et al.

(10) Patent No.: US 10,959,454 B2
(45) **Date of Patent: *Mar. 30, 2021**

(54) ORAL PRODUCT

(71) Applicant: Altria Client Services LLC, Richmond, VA (US)

(72) Inventors: Feng Gao, Midlothian, VA (US); Frank Scott Atchley, Tarpon Springs, FL (US); Gregory Griscik, Midlothian, VA (US); Christopher Joseph DiNovi, Ruther Glen, VA (US); Phillip M. Hulan, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/592,978

(22) Filed: Oct. 4, 2019

(65) Prior Publication Data

US 2020/0029615 A1 Jan. 30, 2020

Related U.S. Application Data

(63) Continuation of application No. 15/943,096, filed on Apr. 2, 2018, now Pat. No. 10,631,568, which is a continuation of application No. 13/744,973, filed on Jan. 18, 2013, now Pat. No. 9,930,909.

(60) Provisional application No. 61/588,890, filed on Jan. 20, 2012.

(51) Int. Cl.
*A24B 15/16* (2020.01)
*A24B 13/00* (2006.01)

(52) U.S. Cl.
CPC ..... *A24B 13/00* (2013.01); *A24B 15/16* (2013.01)

(58) Field of Classification Search
None
See application file for complete search history.

(56) References Cited

U.S. PATENT DOCUMENTS

| | | | |
|---|---|---|---|
| 1,977,059 | A | 10/1934 | Hatherell et al. |
| 2,162,738 | A | 6/1939 | McCoy |
| 3,139,436 | A | 6/1964 | Bicking |
| 3,396,735 | A | 8/1968 | Von Bethmann et al. |

(Continued)

FOREIGN PATENT DOCUMENTS

| | | | |
|---|---|---|---|
| CN | 1064594 | A | 9/1992 |
| CN | 1207251 | A | 2/1999 |

(Continued)

OTHER PUBLICATIONS

European Notice of Opposition Against European Patent No. 2804897, dated Apr. 13, 2017, 22 pages.

(Continued)

*Primary Examiner* — Eric Yaary
(74) *Attorney, Agent, or Firm* — Harness, Dickey & Pierce, P.L.C.

(57) ABSTRACT

An oral product includes a body that is wholly receivable in an oral cavity. The body includes a mouth-soluble polymer matrix, cellulosic fibers embedded in the mouth-soluble polymer matrix, and nicotine or a derivative thereof dispersed in the mouth-soluble polymer matrix. The oral product is adapted to release the nicotine or a derivative thereof from the body when the body is received within the oral cavity and exposed to saliva.

10 Claims, 10 Drawing Sheets

(56) References Cited

U.S. PATENT DOCUMENTS

| | | | |
|---|---|---|---|
| 4,153,063 | A | 5/1979 | Roselius et al. |
| 4,241,090 | A | 12/1980 | Stroz et al. |
| 4,448,208 | A | 5/1984 | Friedrich et al. |
| 4,516,590 | A | 5/1985 | Teng |
| 4,528,993 | A | 7/1985 | Sensabaugh, Jr. et al. |
| 4,660,577 | A | 4/1987 | Sensabaugh et al. |
| 4,848,373 | A | 7/1989 | Lenkey |
| 4,983,405 | A | 1/1991 | Cherukuri et al. |
| 4,987,907 | A | 1/1991 | Townend |
| 5,144,967 | A | 9/1992 | Cartwright et al. |
| 5,372,149 | A | 12/1994 | Roth et al. |
| 5,417,229 | A | 5/1995 | Summers et al. |
| 5,487,792 | A | 1/1996 | King et al. |
| 5,656,284 | A | 8/1997 | Balkin |
| 5,906,811 | A | 5/1999 | Hersh |
| 6,110,495 | A | 8/2000 | Dam |
| 7,798,151 | B2 | 9/2010 | Krukonis et al. |
| 9,930,909 | B2 | 4/2018 | Gao et al. |
| 2004/0101543 | A1 | 5/2004 | Liu et al. |
| 2004/0118422 | A1 | 6/2004 | Lundin et al. |
| 2004/0123873 | A1 | 7/2004 | Calandro et al. |
| 2004/0247669 | A1 | 12/2004 | Gin et al. |
| 2005/0046363 | A1 | 3/2005 | Yamamoto |
| 2005/0053665 | A1 | 3/2005 | Ek et al. |
| 2005/0152971 | A1 | 7/2005 | Rinker et al. |
| 2005/0178398 | A1 | 8/2005 | Breslin et al. |
| 2005/0241658 | A1 | 11/2005 | Pera |
| 2005/0244521 | A1 | 11/2005 | Strickland et al. |
| 2006/0112965 | A1 | 6/2006 | Whalen |
| 2006/0185684 | A1 | 8/2006 | Albino et al. |
| 2006/0191548 | A1 | 8/2006 | Strickland et al. |
| 2007/0186942 | A1 | 8/2007 | Strickland et al. |
| 2007/0283974 | A1 | 12/2007 | May |
| 2008/0124283 | A1 | 5/2008 | Andersen |
| 2008/0202536 | A1 | 8/2008 | Torrence et al. |
| 2008/0209586 | A1 | 8/2008 | Nielsen et al. |
| 2008/0248017 | A1 | 10/2008 | Ron et al. |
| 2008/0317911 | A1 | 12/2008 | Schleef et al. |
| 2009/0133703 | A1 | 5/2009 | Strickland et al. |
| 2009/0214445 | A1 | 8/2009 | Boghani et al. |
| 2009/0293889 | A1 | 12/2009 | Kumar et al. |
| 2009/0293895 | A1 | 12/2009 | Axelsson et al. |
| 2010/0061940 | A1 | 3/2010 | Axelsson et al. |
| 2010/0068270 | A1 | 3/2010 | Turchetta et al. |
| 2010/0163062 | A1 | 7/2010 | Atchley et al. |
| 2010/0170522 | A1 | 7/2010 | Sun et al. |
| 2010/0247594 | A1 | 9/2010 | Kuzma et al. |
| 2010/0247612 | A1* | 9/2010 | Fuisz ..... A24B 3/18 424/443 |
| 2011/0139164 | A1 | 6/2011 | Mua et al. |
| 2011/0139166 | A1 | 6/2011 | Luzenberg, Jr. |
| 2011/0149904 | A1 | 6/2011 | Fong et al. |
| 2011/0236442 | A1 | 9/2011 | Miser et al. |
| 2011/0274628 | A1 | 11/2011 | Borschke |
| 2011/0287681 | A1 | 11/2011 | DeVall |
| 2012/0031415 | A1 | 2/2012 | Essen et al. |
| 2012/0318287 | A1 | 12/2012 | Andersen |
| 2013/0053603 | A1 | 2/2013 | Norstrom et al. |
| 2013/0074855 | A1 | 3/2013 | Holton, Jr. |
| 2013/0186416 | A1 | 7/2013 | Gao et al. |
| 2013/0186417 | A1 | 7/2013 | Gao et al. |
| 2013/0186418 | A1 | 7/2013 | Gao et al. |
| 2013/0186419 | A1 | 7/2013 | Gao et al. |
| 2013/0189333 | A1 | 7/2013 | Gao et al. |

FOREIGN PATENT DOCUMENTS

| | | | |
|---|---|---|---|
| CN | 1054884 | C | 7/2000 |
| CN | 1498080 | A | 5/2004 |
| CN | 1622758 | A | 6/2005 |
| CN | 2720557 | Y | 8/2005 |
| CN | 1903057 | A | 1/2007 |
| CN | 1960648 | A | 5/2007 |
| CN | 1961732 | A | 5/2007 |
| CN | 1997350 | A | 7/2007 |
| CN | 201156955 | Y | 12/2008 |
| CN | 101861145 | A | 10/2010 |
| CN | 101877975 | A | 11/2010 |
| CN | 102300478 | A | 12/2011 |
| CN | 102014654 | B | 5/2016 |
| EA | 005421 | | 2/2005 |
| EA | 005626 | | 4/2005 |
| EP | 0118972 | A2 | 9/1984 |
| EP | 0279776 | A2 | 8/1988 |
| EP | 0288909 | A1 | 11/1988 |
| EP | 1578422 | A2 | 9/2005 |
| EP | 2226171 | A1 | 9/2010 |
| EP | 2265263 | A2 | 12/2010 |
| EP | 2804897 | A1 | 11/2014 |
| EP | 2720557 | B1 | 2/2017 |
| EP | 2804498 | B1 | 7/2018 |
| JP | 2007-515950 | A | 6/2007 |
| JP | 2010-516243 | A | 5/2010 |
| RU | 2291642 | C1 | 1/2007 |
| RU | 2342846 | C2 | 1/2009 |
| WO | WO-86/03102 | A1 | 6/1986 |
| WO | WO-92/20307 | A1 | 11/1992 |
| WO | WO-2001/49124 | A1 | 7/2001 |
| WO | WO-2002/076227 | A1 | 10/2002 |
| WO | WO-2002/076230 | A1 | 10/2002 |
| WO | WO-2004/068965 | A1 | 8/2004 |
| WO | WO-05/046363 | A2 | 5/2005 |
| WO | WO-2006/127772 | A2 | 11/2006 |
| WO | WO-2007/104573 | A2 | 9/2007 |
| WO | WO-20071104574 | A2 | 9/2007 |
| WO | WO-2008/103935 | A2 | 8/2008 |
| WO | WO-2008/133982 | A2 | 11/2008 |
| WO | WO-2009/048522 | A1 | 4/2009 |
| WO | WO-2009/114034 | A1 | 9/2009 |
| WO | WO-2011/063338 | A2 | 5/2011 |
| WO | WO-2011/139943 | A1 | 11/2011 |
| WO | WO-2012/175085 | A1 | 12/2012 |
| WO | WO-2013109931 | A2 | 7/2013 |
| WO | WO-2013109961 | A1 | 7/2013 |

OTHER PUBLICATIONS

Extended European Search Report in European Application No. 16178530.8, dated Aug. 8, 2016.

List and Schmidt, "Medicinal leaves and herbs," Phytopharmaceutical Technology 1989, p. 94.

Russian Office Action in Russian Application No. 2014134071, dated Jan. 26, 2017, 20 pages (with English translation).

Chinese Office Action in Chinese Application No. 201380014374.2, dated Jun. 2, 2016, 16 pages.

Chinese Office Action in Chinese Application No. 201380014374.2, dated Jan. 14, 2016, 14 pages (English translation only).

Dictionary of Chemistry and Chemical Technology, 2003, 4 pages (Chinese only).

Chinese Office Action in Chinese Application No. 201380014374.2, dated Jun. 18, 2015, 12 pages (English translation only).

Australian Office Action in Australian Application No. 2013204417, dated Dec. 5, 2014, 4 pages.

Chinese Office Action in Chinese Application No. 201210167508.1, dated Oct. 10, 2014, 2 pages.

Fibersol, http://www.fibersol.com/products/fibersol-2/,Oct. 2012.

International Preliminary Report on Patentability for PCT/US2013/022204 dated Jul. 22, 2014, 12 pages.

International Preliminary Report on Patentability for PCT/US2013/022252 dated Jul. 22, 2014, 9 pages.

Chinese Office Action in Chinese Application No. 201210167206.4, dated May 22, 2014, 11 pages.

Second Chinese Office Action in Chinese Application No. 201210167332.X, dated May 30, 2014, 5 pages.

Second Chinese Office Action in Chinese Application No. 201210167508.1, dated May 30, 2014, 2 pages (English translation only).

Chinese Office Action in Chinese Application No. 201210167166.3, dated May 22, 2014, 4 pages.

(56) References Cited

OTHER PUBLICATIONS

Chinese Office Action in Chinese Application No. 201210167508.1, dated Dec. 4, 2013, 8 pages.
Chinese Office Action in Chinese Application No. 201210167234.6, dated Jul. 19, 2013, 10 pages.
Chinese Office Action in Chinese Application No. 201210167332.X, dated Dec. 4, 2013, 10 pages.
International Search Report and Written Opinion for PCT/US2013/022252 dated Mar. 6, 2013, 12 pages.
International Search Report and Written Opinion for PCT/US2013/022204 dated Dec. 16, 2013, 17 pages.
Krochta et al., "Edible and Biodegradable Polymer Films: Challenges and Opportunities," Food Technology, 1997, 51:61-74.
Tso, Tobacco Production, "Seed to Smoke," Chemistry and Technology, Blackwell Publishing, 1999, 1-31.
Chinese Office Action in Chinese Application No. 201380014655.8, dated Aug. 31, 2018, English translation thereof.
Observations in preparation for Oral Proceedings in Opposition Against EP Application No. 2804897 dated Aug. 17, 2018.
Recommendations for the characterization of porous solids, Pure & Appl. Chem., vol. 66, No. 8, pp. 1739-1758, 1994.
Porosity and Specific Surface Area Measurements for Solid Materials, P. Klobes, K. Meyer, R. Munro, NIST, Sep. 2006.
Petrophysics MSc Course Notes—Porosity, Dr. Paul Glover.
Evaluation of five methods for measuring mean fibre diameter of fleece samples from New Zealand sheep, R.N. Andrews, H. Hawker, S. F. Crosbie, New Zealand Journal of Experimental Agriculture, 15:1, 23-31, 1987.
Fibre Length, SGS Wool Testing Services, 2011.
Summons to Attend Oral Proceedings Pursuant to Rule 115(1) EPC dated Feb. 2, 2018.
Communication of Notices of Opposition (R.79(2) EPC) dated Jun. 6, 2017.
Response to Communication Pursuant to Rule 115(1) EPC, Opposition against EP2804897, dated Jun. 26, 2018.
Certified Priority Document dated Sep. 19, 2012.
Submission in Opposition Proceedings for application No. EP13702700.9 dated Oct. 16, 2017.
Microcrystalline Cellulose, 46th JECFA (1996).
Brief Communication for application No. EP13702700.9-1102 dated Jul. 2, 2018.
Responsive to the Summons to Attend Oral Proceedings pursuant to Rule 115(1) EPC dated Feb. 2, 2018 Based on PCT/US2013/022252 dated Jun. 28, 2018.
Pilot Spinning of Viscose Staple Fibres., Johanna Eriksson, Degree Project in Engineering Chemistry, Umea University, Dated May 2015.
Observations submitted in Opposition against EP2809897 dated Jun. 26, 2018.
Russian Office Action for corresponding Application No. 2014134071 dated Sep. 26, 2018, and English translation thereof.
European Search Report for corresponding Application No. 18174632.2-1105 dated Nov. 7, 2018.
Chinese Final Office Action for corresponding Application No. 201710270107.1 dated Nov. 8, 2018.
Office Action for corresponding U.S. Appl. No. 15/816,506 dated Dec. 21, 2018.
Canadian Office Action for corresponding Application No. 2,861,995 dated Dec. 7, 2018.
Extended European Search Report for Application No. 18185575.0-1102 dated Dec. 20, 2018.
United States Office Action for corresponding U.S. Appl. No. 15/850,494 dated Apr. 2, 2019.
United States Office Action for corresponding U.S. Appl. No. 15/816,814, dated May 3, 2019.
Notice of Opposition for corresponding European Application No. 16178530.8-1102/3098258, dated May 9, 2019.
Japanese Notice of Reasons for Rejection for corresponding Application No. 2018-032700, dated Jun. 3, 2019, English translation thereof.
Canadian Office Action for corresponding Application No. 2,861,992, dated Jun. 14, 2019.
United States Office Action for corresponding U.S. Appl. No. 15/816,506, dated Jul. 12, 2019.
United States Notice of Allowance for U.S. Appl. No. 15/816,814, dated Aug. 14, 2019.
European Office Action for corresponding Application No. 18185575.0-1102, dated Sep. 5, 2019.
U.S. Appl. No. 61/499,041, dated Jun. 20, 2011.
United States Notice of Allowance for U.S. Appl. No. 15/816,506, dated Jan. 29, 2020.
European Office Action for corresponding Application No. 18174632.2-1105, dated Jan. 23, 2020.
Chinese Reexamination Notice for corresponding Application No. 201710270107.1, dated Nov. 5, 2019.
United States Notice of Allowance for U.S. Appl. No. 15/943,096, dated Dec. 18, 2019.
United States Notice of Allowance for U.S. Appl. No. 15/816,814, dated Nov. 27, 2019.
European Office Action for corresponding Application No. 18185575.0-1102, dated Jan. 24, 2020.
United States Notice of Allowance for U.S. Appl. No. 15/850,494, dated Jan. 14, 2020.
United States Office Action for U.S. Appl. No. 15/850,494, dated Oct. 1, 2019.
Food Applications, International Fiber Corporation, http://buyersguide.supplysideshow.com/media/54/library/49964-313.pdf (Year: 2010).
United States Office Action for U.S. Appl. No. 15/816,506, dated Oct. 25, 2019.
European Office Action for corresponding Application No. 18185575.0, dated Jun. 12, 2020.
European Office Action dated Nov. 11, 2020 for corresponding European Application No. 18185575.0.

* cited by examiner

ORAL PRODUCT

CROSS-REFERENCE TO RELATED APPLICATIONS

This application is a continuation of U.S. application Ser. No. 15/943,096, filed Apr. 2, 2018, which is a continuation of U.S. application Ser. No. 13/744,973, filed Jan. 18, 2013, now allowed, which claims priority to U.S. Provisional Application Ser. No. 61/588,890 filed Jan. 20, 2012, the entire contents of each of which are incorporated herein by reference.

TECHNICAL FIELD

This document relates to oral products including mouth-soluble polymers, cellulosic fibers, and nicotine.

BACKGROUND

Tobacco can be enjoyed by adult tobacco consumers in a variety of forms. Smoking tobacco is combusted and the aerosol either tasted or inhaled (e.g., in a cigarette, cigar, or pipe). Smokeless tobacco products are not combusted and include: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

A growing number of governments are now implementing restrictions on smoking in public places, such as restaurants and transport facilities. In some countries, such as the United States, some workplaces are also covered by public restrictions. Smokeless products may also be banned by certain governments or workplaces.

Trans-buccal systems such as nicotine-containing chewing gum as well as transdermal nicotine delivery systems are well known in the art. These systems, however, do not consistently provide a suitable tobacco-like experience for some adult tobacco consumers.

SUMMARY

This specification describes an oral product that provides a satisfying tactile and/or flavor experience. The oral product includes a body that is at least partially receivable in an oral cavity of an adult consumer. In some embodiments, the body includes a mouth-soluble polymer matrix, cellulosic fibers embedded in the polymer matrix, and nicotine or a derivative thereof dispersed in the body such that it is released when the body is received within the oral cavity and exposed to saliva.

The oral product can provide a tobacco-like flavor experience and favorable tactile experience. Other embodiments of the oral product can include other additives, such as flavorants, sweeteners, vitamins, minerals, therapeutic agents, nutraceuticals, energizing agents, soothing agents, coloring agents, amino acids, chemsthetic agents, antioxidants, food grade emulsifiers, pH modifiers, botanicals, teeth whitening agents, and/or non-nicotine alkaloids (e.g., caffeine). Combinations of additives (e.g., sweeteners, flavorants, and nicotine) can be combined to provide a favorable tactile and flavor experience.

These and other embodiments can each optionally include one or more of the following features. In some embodiments, the oral product's body includes at least 10 weight percent of the mouth-soluble polymer. The oral product can also include a plasticizer dispersed in the mouth-soluble polymer matrix. For example, the plasticizer can be propylene glycol, glycerin, vegetable oil, triglycerides, or a combination thereof. The oral product can also include a sweetener dispersed in the body. The sweetener can be saccharine, sucralose, aspartame, acesulfame potassium, or a combination thereof.

The oral product, according to certain embodiments, is substantially free of tobacco plant tissue. Nicotine added to the oral product can be either synthetic or derived from tobacco. In some embodiments, the oral product includes between 0.1 mg and 6 mg nicotine. In addition to or as an alternative to nicotine, the oral products can include an additive selected from the group consisting of minerals, vitamins, dietary supplements, nutraceuticals, energizing agents, soothing agents, amino acids, chemsthetic agents, antioxidants, botanicals, teeth whitening agents, therapeutic agents, or a combination thereof. The nicotine and/or other additives can be absorbed into the cellulosic fibers and polymer matrix.

The oral product's body can have at least 10 weight percent cellulosic fibers. The cellulosic fibers can be derived from plant tissue. In some embodiments, the cellulosic fibers includes cellulose. The cellulosic fibers can further include lignin and/or lipids. The cellulosic fibers can be non-tobacco cellulosic fibers. For example, the cellulosic fibers can be selected from the following: sugar beet fiber, wood pulp fiber, cotton fiber, bran fiber, citrus pulp fiber, grass fiber, willow fiber, poplar fiber, and combinations thereof. The non-tobacco cellulosic fibers may also be chemically treated prior to use. For example, the cellulosic fibers can be CMC, HPMC, HPC, or other treated cellulosic material.

The oral product can include flavorants. The flavorants can be natural or artificial. Flavorants can be selected from the following: licorice, wintergreen, cherry and berry type flavorants, Drambuie, bourbon, scotch, whiskey, spearmint, peppermint, lavender, cinnamon, cardamon, *apium* graveolents, clove, cascarilla, nutmeg, sandalwood, bergamot, geranium, honey essence, rose oil, vanilla, lemon oil, orange oil, Japanese mint, *cassia*, caraway, cognac, jasmin, chamomile, menthol, ylang ylang, sage, fennel, pimenta, ginger, anise, coriander, coffee, mint oils from a species of the genus *Mentha*, cocoa, and combinations thereof. Synthetic flavorants can also be used. In certain embodiments, a combination of flavorants can be combined to imitate a tobacco flavor. The particular combination of flavorants can be selected from the flavorants that are generally recognized as safe ("GRAS") in a particular country, such as the United States. Flavorants can also be included in the oral product as encapsulated flavorants.

The body of the oral product can have a variety of different shapes, some of which include disk, shield, rectangle, and square. According to certain embodiments, the body can have a length or width of between 5 mm and 25 mm and a thickness of between 1 mm and 10 mm.

The oral product's body can be compressible and springy. In some embodiments, the body has a compressibility @ 250 N of less than 95%, less than 90%, less than 85%, or less than 80%. In some embodiments, the body has a compressibility of @ 250 N of between 45% and 90%. The oral product's body can have a compressibility @ 425 N of less than 99%. For example, the body can have a compressibility @ 425 N of between 60% and 98%. The body can also have a percentage of springiness of at least 20%, at least 30%, at least 40%, at least 50%, at least 60%, at least 70%, or at least 75%. For example, the body can have a percentage of springiness of between 75% and 90%. The oral product, in certain embodiments, is a coated stick. The coating on the stick can include a mouth-soluble polymer, cellulosic fibers in the polymer, and nicotine or a derivative thereof dispersed in the polymer/fiber matrix. The stick can be a wooden dowel.

In general, another aspect of the subject matter described in this specification is methods of making and using the oral product. The methods of making the oral product can include the actions of extruding a mouth-soluble polymer having cellulosic fibers and/or one or more additives dispersed therein.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

Figure 1:
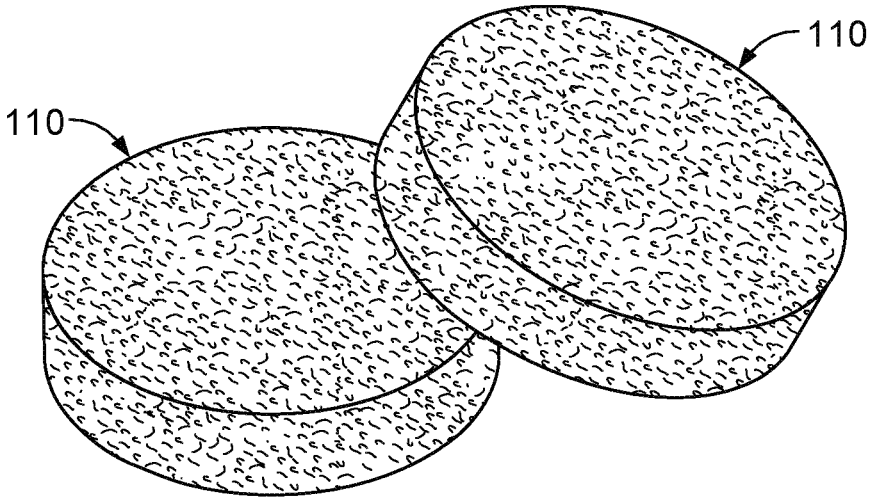
FIG. 1 is a perspective view of a pair of oral products.

The oral products described herein include a mouth-soluble polymer matrix, cellulosic fibers, and one or more additives. The one or more additives can be dispersed in the mouth-soluble polymer matrix such that the one or more additives are released from the oral product when the oral product is received within the oral cavity and exposed to saliva. The oral products described herein can provide a favorable additive release profile and tactile experience.

Suitable mouth-soluble polymers include any polymer that is soluble when placed in an adult consumer's mouth and non-toxic. As used here, the term "mouth soluble" means that the polymer experiences significant degradation when exposed to saliva within an oral cavity and at the normal human body temperature (e.g., about 98.6° F.) over a period of four hours. In some embodiments, the mouth-soluble polymer will disintegrate within an oral cavity and exposed to saliva at the normal human body temperature for a period of at less than 1 hour, less than 30 minutes, less than 10 minutes, less than 5 minute, or less than 1 minute. Suitable polymers include as cellulosics (e.g., carboxymethyl cellulose (CMC), hydroxypropyl cellulose (HPC), hydroxyethyl cellulose (HEC), hydroxypropyl methyl cellulose (HPMC), and methyl cellulose (MC)), natural polymers (e.g., starches and modified starches, konjac, collagen, inulin, soy protein, whey protein, casein, and wheat gluten), seaweed-derived polymers (e.g., carrageenan (kappa, iota, and lambda), alginates, and propylene glycol alginate), microbial-derived polymers (e.g., xanthan, dextran, pullulan, curdlan, and gellan), extracts (e.g., locust bean gum, guar gum, tara gum, gum tragacanth, pectin (e.g., low methoxy and amidated), agar, zein, karaya, gelatin, *psyllium* seed, chitin, and chitosan), exudates (e.g., gum acacia (arabic) and shellac), and synthetic polymers (e.g., polyvinyl pyrrolidone, polyethylene oxide, and polyvinyl alcohol). Other useful mouth-soluble polymers are known in the art, for example, see *Krochta et al. Food Technology,* 1997, 51:61-74, Glicksman Food Hydrocolloids CRC 1982, Krochta Edible Coatings and Films to Improve Food Quality Technomic 1994, Industrial Gums Academic 1993, Nussinovitch Water-Soluble Polymer Applications in Foods Blackwell Science 2003.

One or more additives are included in the oral product and adapted to be released from the oral product when the oral product is placed in an oral cavity. The oral product, in some embodiments, includes nicotine. The oral product can include a combination of nicotine, sweeteners, and flavorants to mimic the flavor profile and tactile experience of certain tobacco products.

In some embodiments, a nicotine-containing oral product can be substantially free of tobacco plant tissue. As used herein, the term "tobacco plant tissue" refers to processed or non-processed cellulosic parts (e.g., leaves, stems) of a member of the genus *Nicotiana*, but does not include extracts of tobacco (e.g., tobacco-derived nicotine). For example, an oral product can include one or more organoleptic components extracted from raw or processed tobacco, yet be substantially free of tobacco plant tissue.

In addition to additives, sweeteners, and flavorants, the oral product can also include fibers, fillers, plasticizers, and/or processing aids. Fibers can help to provide access to the additives, sweeteners, and/or flavorants, even before the oral product disintegrates. Fibers can provide channels for additives, sweeteners, and/or flavorants to leach out of the mouth-soluble polymer matrix. The fiber-polymer matrix can absorb one or more additives and provide a pathway for one or more additives to be released from the oral product. The fiber-polymer matrix can be porous. In some embodiments, the fiber-polymer matrix can have a plurality of pores having a pore diameter of between 40 microns and 60 microns and a plurality of pores having a pore diameter of between 1 micron and 10 microns. During use, saliva can be absorbed into the fiber-polymer matrix to release the additives, sweeteners, and/or flavorants. The absorbed saliva can then cause the polymer matrix to further disintegrate from the inside, thus providing additional access to the additives in the matrix. Moreover, the fibers can swell to further provide increased access to the matrix. Mechanical action (e.g., chewing) of the oral product can also facilitate the disintegration of the polymer matrix and the release of the additives, sweeteners, and/or flavorants.

Fillers can also be included in the mouth-soluble polymer matrix to alter the texture or pliability of the oral product. The mouth-soluble polymer matrix can also include plasticizers, which can increase the softness of the oral product. Processing aids can also be present in the oral product and be used to facilitate shaping processes.

Oral Product Shapes and Packaging

FIG. 1 depicts an example of an oral product 110. The oral product 110 has a disk shape. For example, the oral product 110 can have a diameter of about 12 mm and a thickness of about 2.5 mm.

Figure 2A:
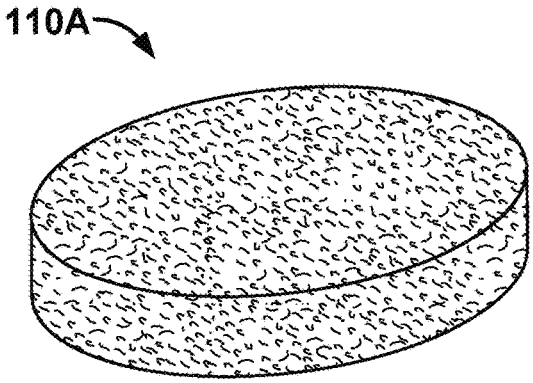
FIGS. 2A-2O illustrate various exemplary shapes of oral products.
Figure 2B:
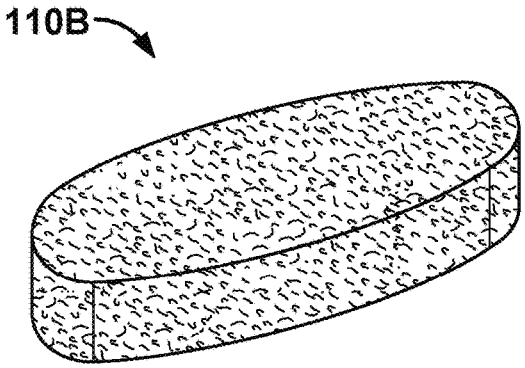
Figure 2C:
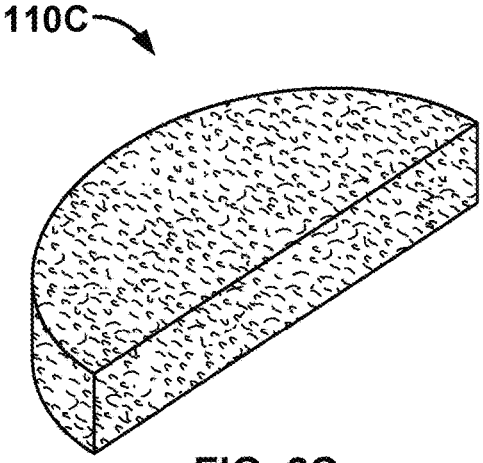
Figure 2D:
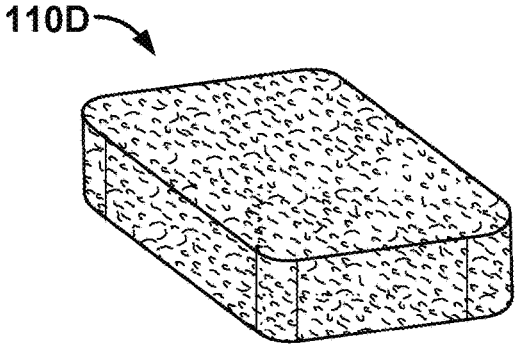
Figure 2E:
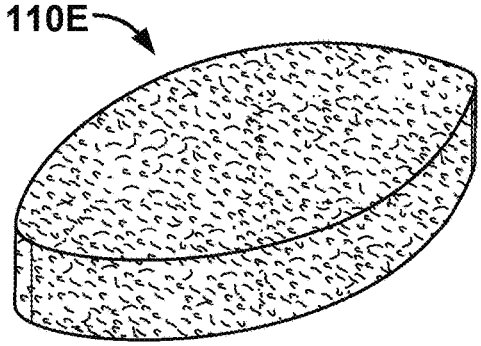
Figure 2F:
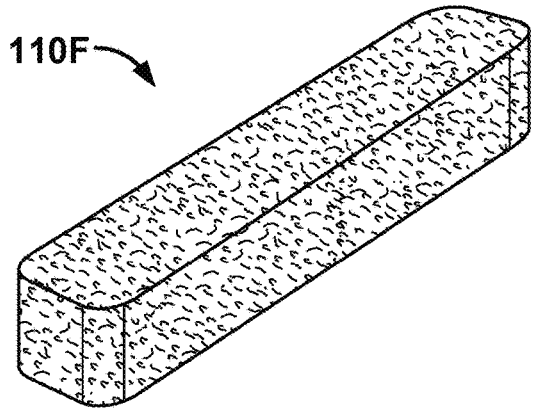
Figure 2G:
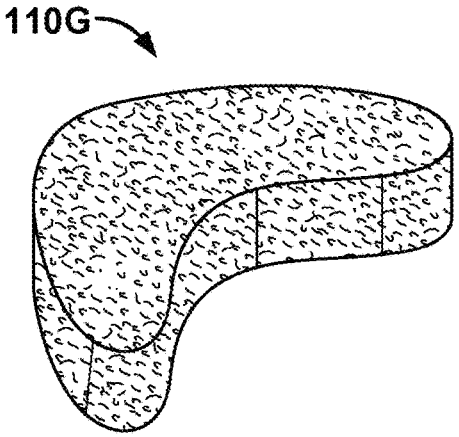
Figure 2H:
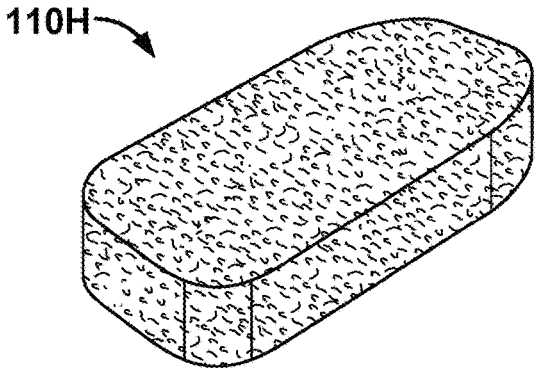
Figure 2I:
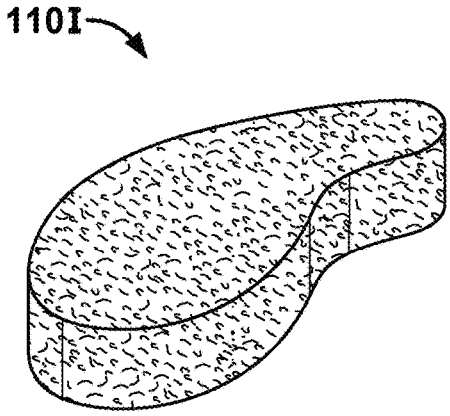
Figure 2J:
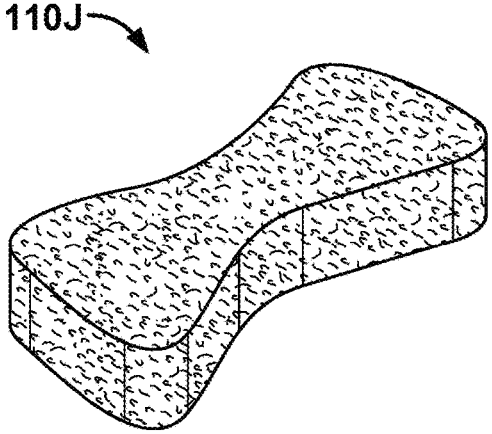
Figure 2K:
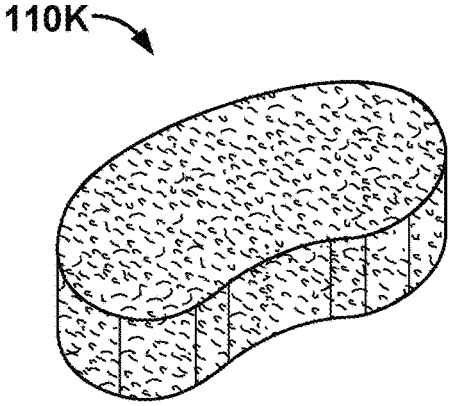
Figure 2L:
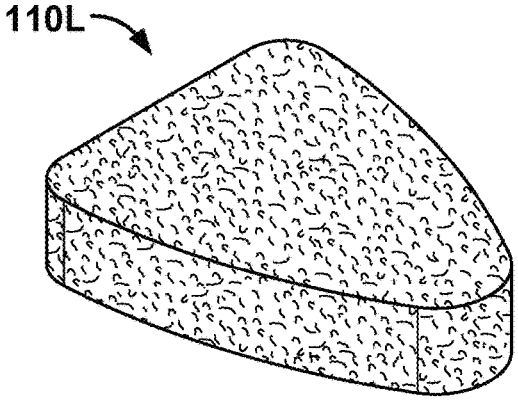
Figure 2M:
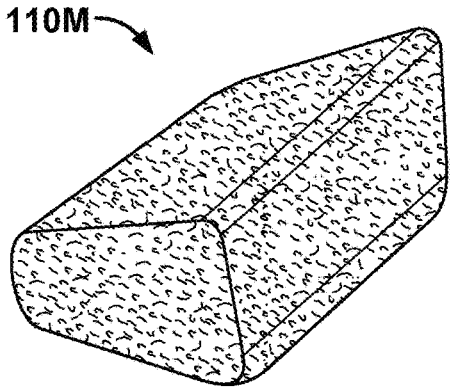
Figure 2N:
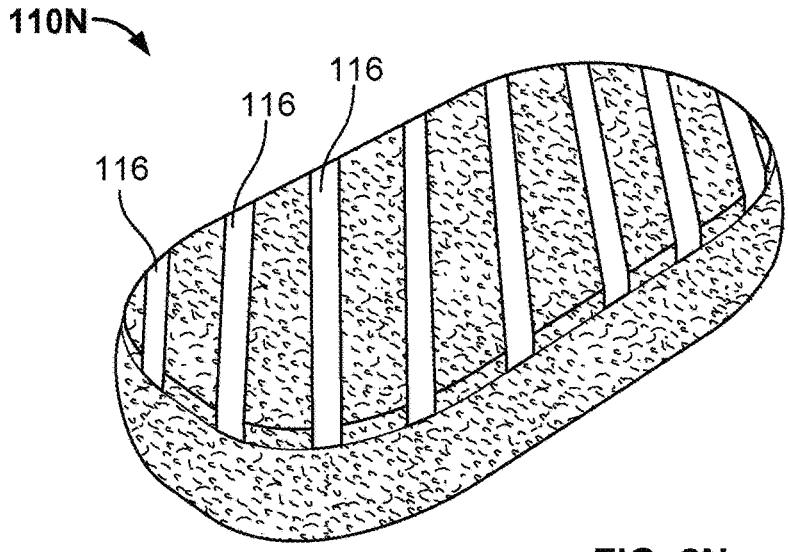

Referring now to FIGS. 2A-2N, the oral product 110 can be molded into any desired shape. For example, referring to FIGS. 2A-2L, the oral product 110A-L can be formed in a shape that promotes improved oral positioning in the oral cavity, improved packaging characteristics, or both. In some circumstances, the oral product 110A-L can be configured to be: (A) an elliptical-shaped oral product 110A; (B) an elongated elliptical-shaped oral product 110B; (C) semi-circular oral product 110C; (D) square or rectangular-shaped oral product 110D; (E) football-shaped oral product 110E; (F) elongated rectangular-shaped oral product 110F; (G) boomerang-shaped oral product 110G; (H) rounded-edge rectangular-shaped oral product 110H; (I) teardrop- or comma-shaped oral product 110I; (J) bowtie-shaped oral product 110J; (K) peanut-shaped oral product 110K; and (L) shield-shaped oral product. Alternatively, the oral product can have different thicknesses or dimensionality, such that a beveled article (e.g., a wedge) is produced (see, for example, product 110M depicted in FIG. 2M) or a hemi-spherical shape is produced. In some embodiments, the oral product has a shield shape.

In addition or in the alternative to flavorants being included within the mouth-soluble polymer matrix, flavorants can be included on an exterior of the oral product 110. For example, referring to FIG. 2N, for example, some embodiments of an oral product 110N can be equipped with flavor strips 116.

Figure 2O:
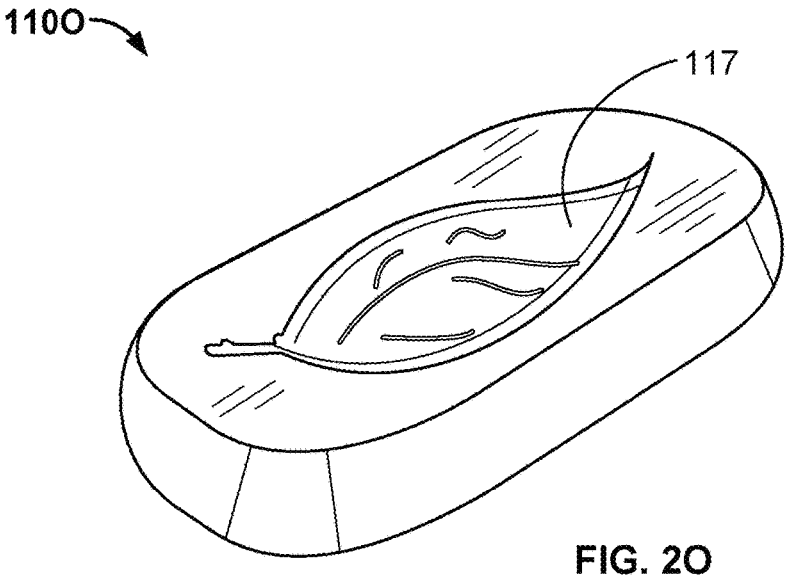

Referring to FIG. 2O, particular embodiments of the oral product 110 can be embossed or stamped with a design (e.g., a logo, an image, or the like). For example, the oral product 110O can be embossed or stamped with any type of design 117 including, but not limited to, a trademark, a product name, or any type of image. The design 117 can be formed directly into the oral product, arranged along the exterior of the product 110O. The design 117 can also be embossed or stamped into those embodiments with a dissolvable film 116 applied thereto.

In some embodiments, the oral product 110 or products 110A-O can be wrapped or coated in an edible or dissolvable film, which may be opaque, substantially transparent, or translucent. The dissolvable film can readily dissipate when the oral product 110 is placed in an oral cavity. In some embodiments, the oral product 110 can be coated with a mouth-stable material. Exemplary coating materials include Beeswax, gelatin, acetylated monoglyceride, starch (e.g., native potato starch, high amylose starch, hydroxypropylated potato starch), Zein, Shellac, ethyl cellulose, methylcellulose, hydroxypropyl methylcellulose, carboxymethyl cellulose, and combinations thereof. For example, a coating can include a combination of gelatin and methylcellulose. In some embodiments, a coating material can include a plasticizer. In some case, a coating can include a colorant, a flavorant, and/or a one or more of the additives discussed above. For example, a coating can include nicotine to provide a user with an initial nicotine burst. In some cases, the matrix of mouth-stable polymer 120 can have surfaces roughened to improve the adherence of a coating. In some cases, a coating can provide a glossy or semi-glossy appearance, a smooth surface, and/or an appealing visual aesthetic (e.g., a nice color). In some embodiments, the coating (e.g., a Beeswax, Zein, acetylated monoglyceride, and/or hydroxypropylated potato starch coating) can provide a soft mouth feel. In some embodiments, the coating (e.g., a methylcellulose, hydroxypropyl methylcellulose, carboxymethyl cellulose, ethyl cellulose, and/or gelatin coating) can provide a hard outer coating.

One or more oral products 110 can be packaged in a variety of conventional and non-conventional manners. For example, a plurality of oral products 110 can be packaged in a container having a lid. In other embodiments, a plurality of oral products 110 can be stacked and packaged in a paper, plastic, and/or aluminum foil tube. The packaging can have a child-resistant lid.

Figure 3A:
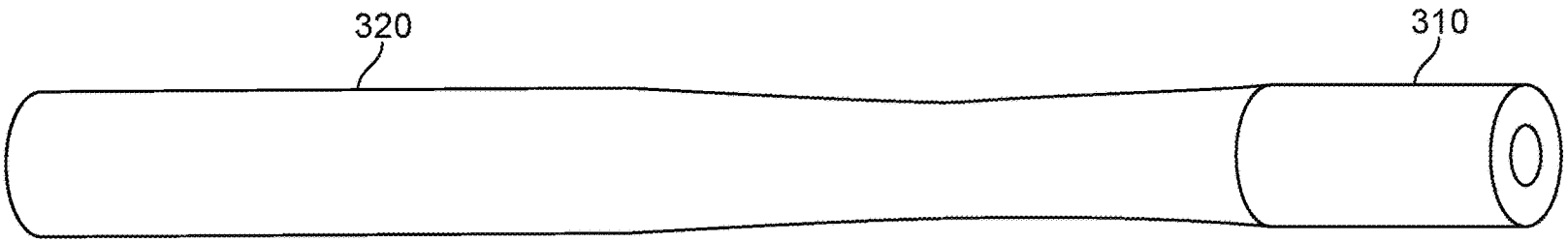
FIG. 3A-3J illustrate oral products having various rod, stick, or tube configurations.
Figure 3B:
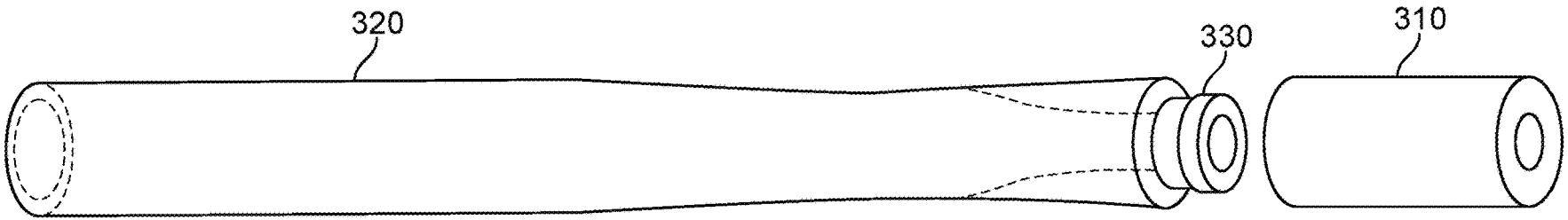

The oral product 110 can also include additional elements. In some embodiments, a mouth-soluble polymer matrix including nicotine or a derivative thereof can be attached to a rod, tube, or stick. For example, FIGS. 3A-3J illustrate tubes attached to a mouth-soluble polymer matrix tips. FIG. 3A depicts an embodiment of an oral product having a tip piece 310 and a tube piece 320. The tip piece 310 can include the mouth-soluble polymer matrix having fibers and/or one or more additives within the polymer matrix. The tip piece 310 can be sized and shaped to be at least partially received in an oral cavity. The tube piece 320 can be made of any conventional polymer. During use the tube piece 320 can act as holder for the tip piece 310. The tube piece 320 and the tip piece 310 can be attached by a snap-fit attachment feature 330, as shown in FIG. 3B.

Figure 3C:
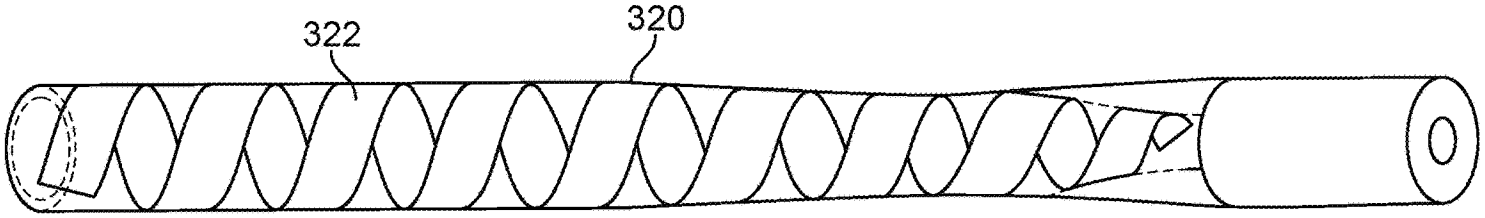
Figure 3D:
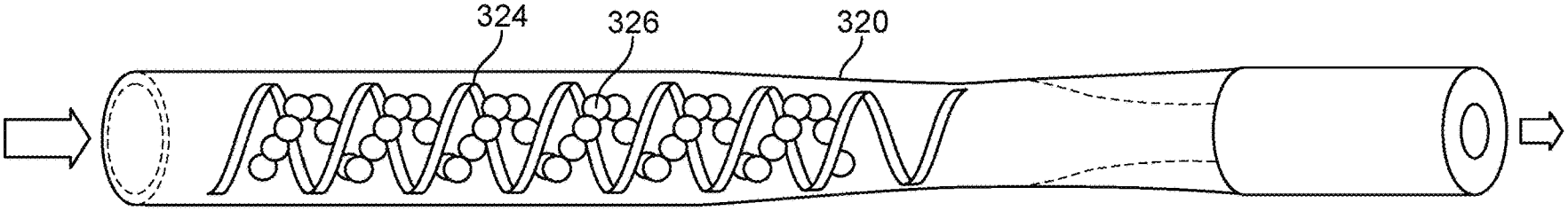
Figure 3E:
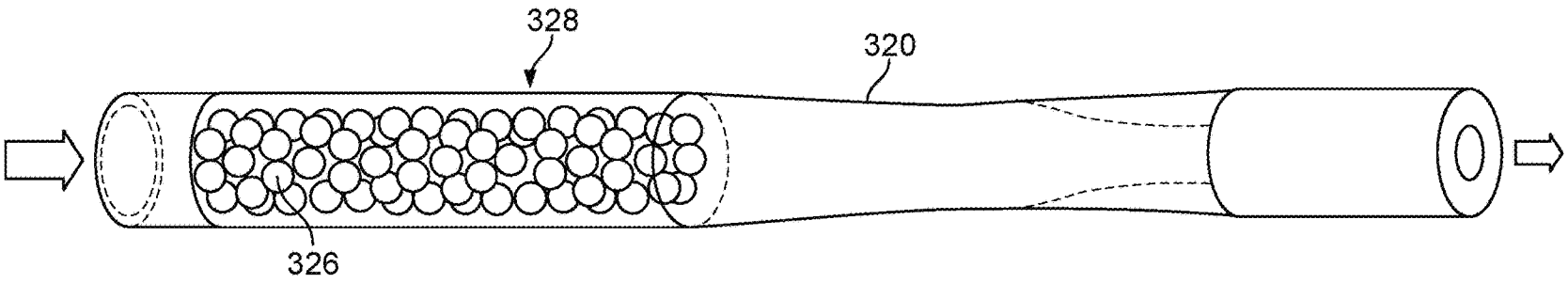
Figure 3F:
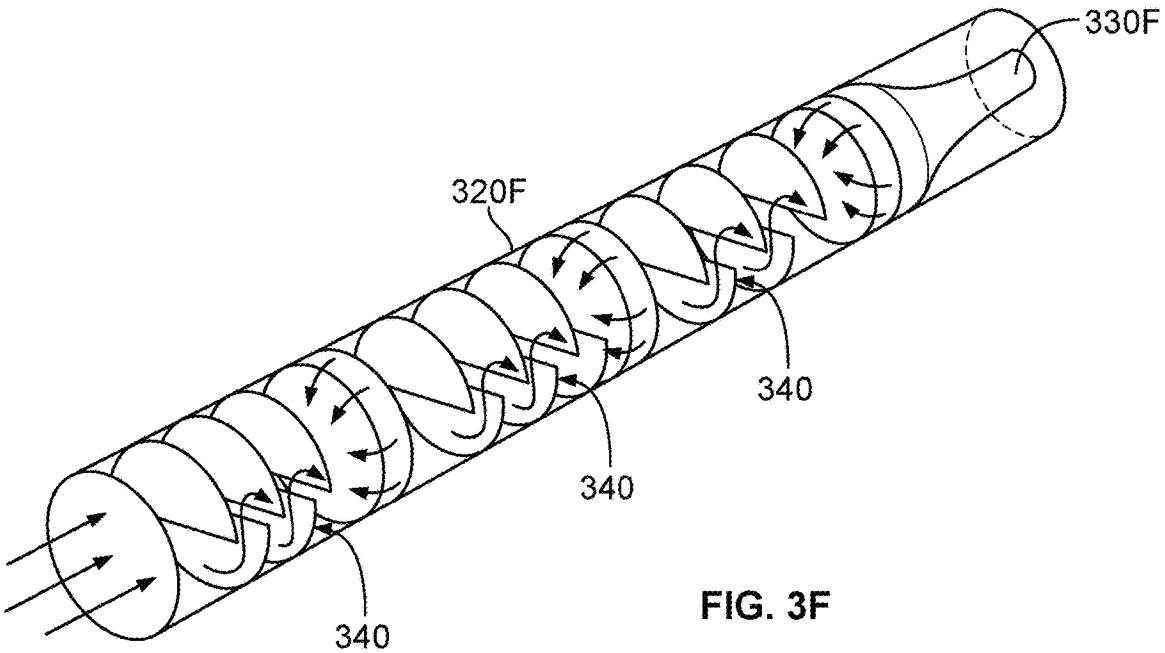

The tube piece 320 can be reusable. For example, multiple tip pieces 310 can be packaged with a single tube piece 320 and a user can replace the tip pieces 310 after using an initial tip piece. In other embodiments, the tube pieces 320 can be intended for a single use. In some embodiments, the tube pieces 320 can include flavorants within the tube. The flavorants can be adapted to be released when air is drawn through the tube 320. For example, FIG. 3C depicts a tube including a flavor ribbon 322. FIG. 3D depicts a tube 320 including a flavor strip 324 and a plurality of flavor beads 326. FIG. 3E depicts a tube 320 including a compressed mass 328 of flavor beads 326. In some embodiments, the inside of the tube can have structure adapted to alter the flow pattern of air drawn into the tube. For example, FIG. 3F depicts a tube 320F having a series of steps and constrictions 340 adapted to alter the flow pattern of air drawn into the tube. FIG. 3F also depicts an alternative connection feature 330F.

Figure 3G:
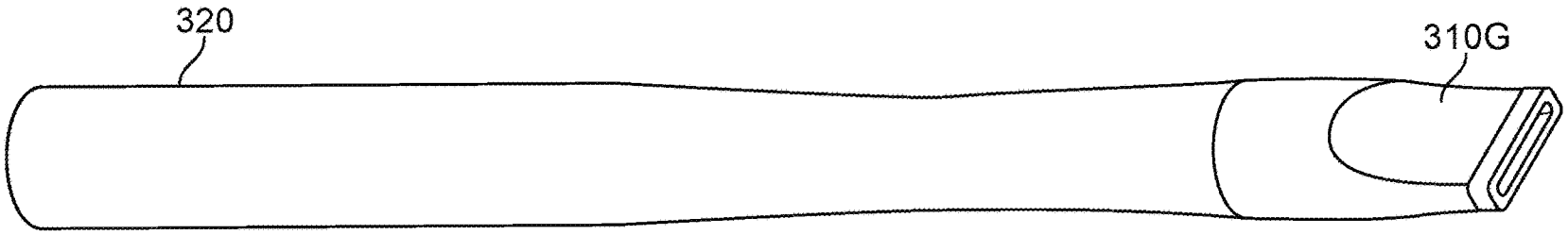

FIG. 3G depicts an embodiment having a recorder-like shape. As shown, a tip piece 310G is connected to the contoured tube piece 320. For example, the recorder-shaped tip 310G can be composed of a mouth-soluble polymer matrix that includes cellulosic fibers, nicotine, one or more sweeteners, and one or more flavorants. As shown, the tip piece 310G is sized and shaped to be at least partially received within an adult's oral cavity.

Figure 3H:
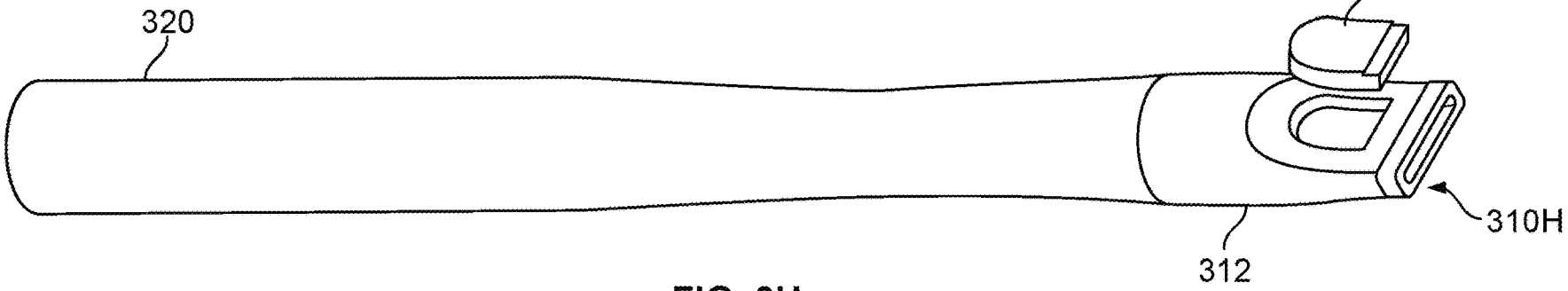
Figure 3I:
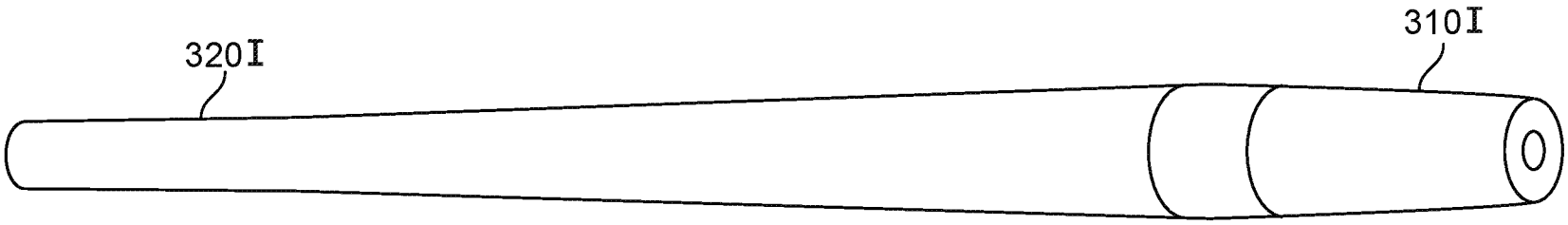
Figure 3J:
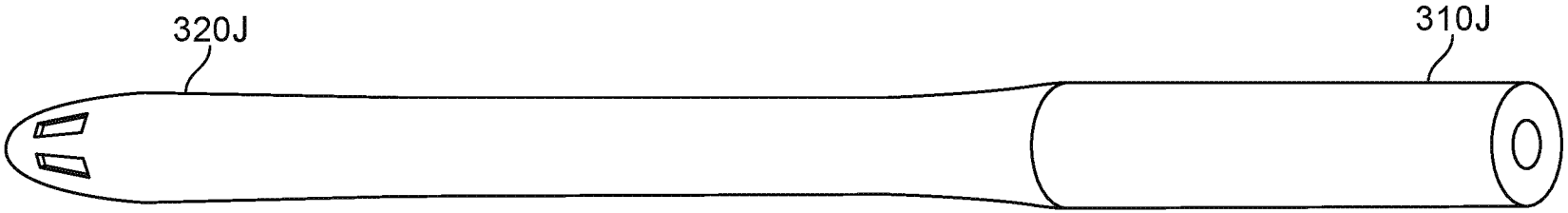

FIG. 3H depicts a similarly shaped oral product having a plastic recorder-shaped tip 310H that includes a reusable plastic part 312 and a mouth-soluble polymer matrix part 315. FIGS. 3I and 3J depict embodiments having alternatively shaped tip pieces 310I and 310J. FIG. 3I depicts an embodiment having a tapered tube 320I. FIG. 3J depicts an embodiment having vent holes at the non-tip end of the tube piece 320J.

In some embodiments, a system or kit of different tubes and rods and/or different tips can be packaged together, each having the same type of attachment features. Embodiments having each of the combinations of tips and tubes or rods shown in FIGS. 3A-3J are contemplated.

Figure 4:
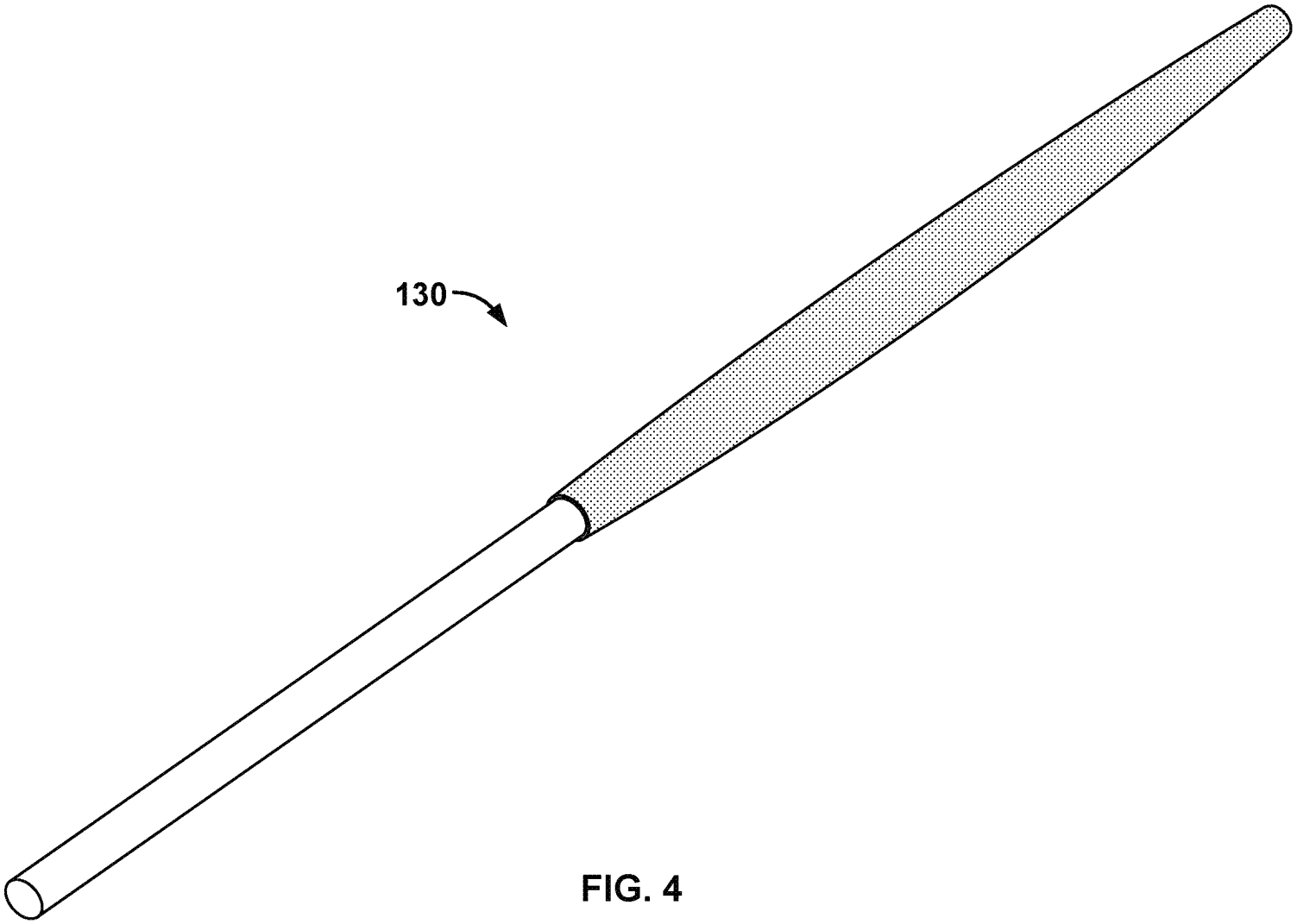
FIG. 4 depicts a coated stick.

FIG. 4 depicts a coated stick 130. The stick can be a wooden dowel having a length of between 2 cm and 10 cm and a diameter of between 0.5 mm and 5 mm. In certain embodiments, one end of the stick is coated with a matrix of mouth-soluble polymer, cellulosic fiber, and nicotine. In some embodiments, at least 50% of the stick is coated. In other embodiments, the entire stick is coated.

Oral Product Properties

The oral product 110 can provide a favorable tactile experience (e.g., mouth feel). The oral product 110 can also retain its shape during processing, shipping, handling, and optionally use. In some embodiments, the oral product 110 can have an elasticity allowing an adult consumer to work the product within the mouth. In some embodiments, the oral product 110 has at least some shape memory and thus can return to shape after being squeezed between teeth in an oral cavity. Working of the oral product 110 within the oral cavity can accelerate the release of the additives, sweeteners, and/or flavorants within the mouth-soluble polymer matrix.

During use, the oral product 110 can absorb saliva into the polymer-fiber matrix. The saliva can cause the polymer-fiber matrix to swell, which can further increase access to different sections of the polymer-fiber matrix. As the product is worked in the mouth, saliva can access different sections of the polymer-fiber matrix. The oral product 110 can be worked in the mouth without significant instantaneous permanent plastic deformation. As the product is worked and begins to disintegrate, it becomes more pliable and additional additives can become available for release into the oral cavity. As the product is used, it can initially increase in both weight and volume before it disintegrates.

One way of characterizing the properties of the oral product is by measuring the compressibility and springiness of the product. The compressibility can be calculated as a percentage of reduction in thickness of the sample when the sample is compressed with a standardized probe with a particular force. As used herein, the term "compression @ 250 N test" defines a test of a sample where the sample is placed on a flat stationary surface and twice compressed with a 10 mm-diameter-sphere-tipped probe with a force of 250 N with a hold time of 30 seconds between compressions. The "percentage of compression @ 250 N" is the maximum amount of reduction in thickness of the sample during the compression @ 250 N test. For example, if a 3 mm thick sample is compressed to a minimum thickness of 1.5 mm during either of the two compressions, the sample is said to have a 50% compression @ 250 N. As used herein, the term "compression @ 425 N test" defines a test of a sample where the sample is placed on a flat stationary surface and twice compressed with a 10 mm-diameter-sphere-tipped probe with a force of 425 N with a hold time of 30 seconds between compressions. For comparison, a normal human bite force is typically between 400 and 500 N.

In some embodiments, the oral product 110 has a percentage of compression @ 250 N of less than 95%. In certain embodiments, the oral product 110 has a percentage of compression @ 250 N of less than 90%, less than 85%, or less than 80%. In certain embodiments, the oral product 110 has a percentage of compression @ 250 N of at least 10%, at least 25%, or at least 40%. For example, the oral product can have a percentage of compression @ 250 N of between 45% and 80%. In some embodiments, the oral product 110 has a percentage of compression @ 425 N of less than 99%. In certain embodiments, the oral product 110 has a percentage of compression @ 425 N of less than 98%, less than 97%, or less than 96%. In certain embodiments, the oral product 110 has a percentage of compression @ 425 N of at least 10%, at least 25%, at least 50%, or at least 60%. For example, the oral product can have a percentage of compression @ 425 N of between 65% and 98%.

The springiness of a sample can be measured by measuring the percentage of recovery after a sample is compressed. As used herein, the term "percentage of springiness" means the percentage of thickness recovery of the sample during a 30 second recovery time after being compressed by the compression @ 425 N test using the 10 mm-diameter-sphere-tipped probe. For example, if a sample is compressed from an original thickness of 3.0 mm to a thickness of 2.0 mm and then recovers to 2.5 mm after 30 seconds, the springiness of the sample would be 50%. In some embodiments, the oral product 110 has a percentage of springiness of at least 20%. In certain embodiments, the oral product 110 has a percentage of springiness of at least 40%, at least 50%, at least 60%, at least 70%, at least 75%, or at least 80%. In certain embodiments, the percentage of springiness is less than 95%, less than 90%, or less than 87%. For example, the oral product can have a percentage of springiness of between 75% and 90%.

The particular materials used in the oral product 110 and the processing techniques discussed below can have an impact on the compressibility and springiness of the oral product. In addition to different materials have different compressibility and springiness properties, the incorporation of air bubbles or channels, or different fillers and/or fibers can also have an impact on the elasticity and pliability of the oral product. Additionally, the material properties of the overall oral product 110 can change as additives are released. In some embodiments, fibers and/or fillers can also dissolve or disintegrate during use and thus alter the material properties of the oral product 110 during use.

The oral product 110 can have a variety of colors. In some embodiments, the oral product 110 has an off-white color. In other embodiments, natural and artificial coloring can be added to the mouth-soluble polymer before or during the molding process to form oral products 110 having a predetermined color. Encapsulated flavors can be added during the extrusion process to create speckles, patterns or dots within the oral product.

Polymers

The mouth-soluble polymer can be a variety of different biocompatible and dissolvable polymers. In some embodiments, the mouth-soluble polymer is a polymer generally recognized as safe. Suitable polymers include cellulosics (e.g., carboxymethyl cellulose (CMC), hydroxypropyl cellulose (HPC), hydroxyethyl cellulose (HEC), hydroxypropyl methyl cellulose (HPMC), and methyl cellulose (MC)), natural polymers (e.g., starches and modified starches, konjac, collagen, inulin, soy protein, whey protein, casein, and wheat gluten), seaweed-derived polymers (e.g., carrageenan (kappa, iota, and lambda), alginates, and propylene glycol alginate), microbial-derived polymers (e.g., xanthan, dextran, pullulan, curdlan, and gellan), extracts (e.g., locust bean gum, guar gum, tara gum, gum tragacanth, pectin (e.g., low methoxy and amidated), agar, zein, karaya, gelatin, *psyllium* seed, chitin, and chitosan), exudates (e.g., gum acacia (arabic) and shellac), and synthetic polymers (e.g., polyvinyl pyrrolidone, polyethylene oxide, and polyvinyl alcohol). Other useful mouth-soluble polymers are known in the art, for example, see Krochta et al. Food Technology, 1997, 51:61-74, Glicksman Food Hydrocolloids CRC 1982, Krochta Edible Coatings and Films to Improve Food Quality Technomic 1994, Industrial Gums Academic 1993, Nussinovitch Water-Soluble Polymer Applications in Foods Blackwell Science 2003.

The mouth-soluble polymer forms the mouth-soluble polymer matrix of the oral product 110. In some embodiments, the oral product includes at least 10 weight percent of one or more mouth-soluble polymers. In certain embodiments, the oral product includes at least 20 weight percent, at least 30 weight percent, at least 40 weight percent, at least 50 weight percent, at least 60 weight percent, at least 70 weight percent, at least 80 weight percent, or at least 90 weight percent of one or more mouth-soluble polymers. In certain embodiments, the oral product includes between 10 and 90 weight percent of one or more mouth-soluble polymers. Accordingly to some embodiments, the oral product includes between 40 and 80 weight percent of the mouth-soluble polymers. Some embodiments of the oral product have between 55 and 70 weight percent polymers.

The mouth-soluble polymer according to certain embodiments has a flexural modulus of at least 5 MPa when tested according to ASTM Testing Method D790 or ISO 178 at 23 degrees Celsius. In some embodiments, the flexural modulus is at least 10 MPa. For example, the flexural modulus can be between 10 MPa and 30 MPa. In some embodiments, the mouth-soluble polymer can have a shore Hardness of 50 Durometers or less, a melt flow index of 3 g/10 min at 200° C./10 kg, a tensile strength of 10 MPa or more (using ISO 37), and a ultimate elongation of less than 100% (using ISO 37).

Additives

A variety of additives can be included in the oral product 110. The additives can include alkaloids (e.g., nicotine or caffeine), minerals, vitamins, dietary supplements, nutraceuticals, energizing agents, soothing agents, coloring agents, amino acids, chemsthetic agent, antioxidants, food grade emulsifiers, pH modifiers, botanicals (e.g., green tea), teeth whitening (e.g., SHRIMP), therapeutic agents, sweeteners, flavorants, and combinations thereof. In certain embodiments, the additives include nicotine, sweeteners, and flavorants. With certain combinations of nicotine, sweeteners, and flavorants, the oral product may provide a flavor profile and tactile experience similar to certain tobacco products.

Nicotine

Nicotine within the oral product can be tobacco-derived nicotine, synthetic nicotine, or a combination thereof. In certain embodiments, the oral product includes between 0.1 mg and 6.0 mg of nicotine. In some of these embodiments, the oral product includes between 1.0 mg and 3.0 mg of nicotine.

Tobacco-derived nicotine includes one or more other tobacco organoleptic components other than nicotine. The tobacco-derived nicotine can be extracted from raw (e.g., green leaf) tobacco and/or processed tobacco. Processed tobaccos can include fermented and unfermented tobaccos, dark air-cured, dark fire cured, burley, flue cured, and cigar filler or wrapper, as well as the products from the whole leaf stemming operation. The tobacco can also be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. By processing the tobacco prior to extracting nicotine and other organoleptic components, the tobacco-derived nicotine may include ingredients that provide a favorable experience.

The tobacco-derived nicotine can be obtained by mixing cured and fermented tobacco with water or another solvent (e.g., ethanol) followed by removing the insoluble tobacco material. The tobacco extract may be further concentrated or purified. In some embodiments, select tobacco constituents can be removed. Nicotine can also be extracted from tobacco in the methods described in the following patents: U.S. Pat. Nos. 2,162,738; 3,139,436; 3,396,735; 4,153,063; 4,448,208; and 5,487,792.

The nicotine can also be purchased from commercial sources, whether tobacco-derived or synthetic. In other embodiments, the oral product can include a derivative of nicotine (e.g., a salt of nicotine).

Antioxidants

The oral product 110 can also include one or more antioxidants. In some embodiments, an oral product 110 can include a combination of nicotine and antioxidants. Antioxidants can result in a significant reduction in the conversion of nicotine into nicotine-N-oxide when compared to oral products without antioxidants. In some cases, an oral product can include 0.01 and 5.00 weight percent antioxidant, between 0.05 and 1.0 weight percent antioxidant, between 0.10 and 0.75 weigh percent antioxidant, or between 0.15 and 0.5 weight percent antioxidant. Suitable examples of antioxidants include ascorbyl palmitate (a vitamin C ester), BHT, ascorbic acid (Vitamin C), and sodium ascorbate (Vitamin C salt). In some embodiments, monosterol citrate, tocopherols, propyl gallate, tertiary butylhydroquinone (TBHQ), butylated hydroxyanisole (BHA), Vitamin E, or a derivative thereof can be used as the antioxidant. For example, ascorbyl palmitate can be the antioxidant in the formulations listed in Table I. Antioxidants can be incorporated into the polymer (e.g., polyurethane) during an extrusion process or after the polymer is extruded (e.g., during a post-extrusion flavoring process).

In some cases, the oral product 110 can have a conversion of less than 0.50% of nicotine into nicotine-N-oxide after aging the oral product 110 for 2 weeks at 25° C. and 65% relative humidity. In some cases, the oral product 110 can have a conversion of less than 0.20% of nicotine into nicotine-N-oxide after aging the oral product 110 for 2 weeks at 25° C. and 65% relative humidity. In some cases, the oral product 110 can have a conversion of less than 0.70% of nicotine into nicotine-N-oxide after aging the oral product 110 for 4 weeks at 25° C. and 65% relative humidity. In some cases, the oral product 110 can have a conversion of less than 0.30% of nicotine into nicotine-N-oxide after aging the oral product 110 for 4 weeks at 25° C. and 65% relative humidity. In some cases, the oral product 110 can have a conversion of less than 0.80% of nicotine into nicotine-N-oxide after aging the oral product 110 for 6 weeks at 25° C. and 65% relative humidity. In some cases, the oral product 110 can have a conversion of less than 0.40% of nicotine into nicotine-N-oxide after aging the oral product 110 for 6 weeks at 25° C. and 65% relative humidity. In some cases, the oral product 110 can have a conversion of less than 0.30% of nicotine into nicotine-N-oxide after aging the oral product 110 for 6 weeks at 25° C. and 65% relative humidity. In some cases, the oral product 110 can have a conversion of less than 0.85% of nicotine into nicotine-N-oxide after aging the oral product 110 for 8 weeks at 25° C. and 65% relative humidity. In some cases, the oral product 110 can have a conversion of less than 0.50% of nicotine into nicotine-N-oxide after aging the oral product 110 for 8 weeks at 25° C. and 65% relative humidity. In some cases, the oral product 110 can have a conversion of less than 0.85% of nicotine into nicotine-N-oxide after aging the oral product 110 for 10 weeks at 25° C. and 65% relative humidity. In some cases, the oral product 110 can have a conversion of less than 0.55% of nicotine into nicotine-N-oxide after aging the oral product 110 for 10 weeks at 25° C. and 65% relative humidity. In some cases, the oral product 110 can have a conversion of less than 0.95% of nicotine into nicotine-N-oxide after aging the oral product 110 for 12 weeks at 25° C. and 65% relative humidity. In some cases, the oral product 110 can have a conversion of less than 0.60% of nicotine into nicotine-N-oxide after aging the oral product 110 for 12 weeks at 25° C. and 65% relative humidity. In some cases, the oral product 110 can have a conversion of less than 1.0% of nicotine into nicotine-N-oxide after aging the oral product 110 for 2 weeks at 40° C. and 75% relative humidity. In some cases, the oral product 110 can have a conversion of less than 0.5% of nicotine into nicotine-N-oxide after aging the oral product 110 for 2 weeks at 40° C. and 75% relative humidity. In some cases, the oral product 110 can have a conversion of less than 1.4% of nicotine into nicotine-N-oxide after aging the oral product 110 for 4 weeks at 40° C. and 75% relative humidity. In some cases, the oral product 110 can have a conversion of less than 0.8% of nicotine into nicotine-N-oxide after aging the oral product 110 for 4 weeks at 40° C. and 75% relative humidity. In some cases, the oral product 110 can have a conversion of less than 1.6% of nicotine into nicotine-N-oxide after aging the oral product 110 for 6 weeks at 40° C. and 75% relative humidity. In some cases, the oral product 110 can have a conversion of less than 1.2% of nicotine into nicotine-N-oxide after aging the oral product 110 for 6 weeks at 40° C. and 75% relative humidity. In some cases, the oral product 110 can have a conversion of less than 0.9% of nicotine into nicotine-N-oxide after aging the oral product 110 for 6 weeks at 40° C. and 75% relative humidity. In some cases, the oral product 110 can have a conversion of less than 1.7% of nicotine into nicotine-N-oxide after aging the oral product 110 for 8 weeks at 40° C. and 75% relative humidity. In some cases, the oral product 110 can have a conversion of less than 1.4% of nicotine into nicotine-N-oxide after aging the oral product 110 for 8 weeks at 40° C. and 75% relative humidity. In some cases, the oral product 110 can have a conversion of less than 1.1% of nicotine into nicotine-N-oxide after aging the oral product 110 for 8 weeks at 40° C. and 75% relative humidity. In some cases, the oral product 110 can have a conversion of less than 1.8% of nicotine into nicotine-N-oxide after aging the oral product 110 for 10 weeks at 40° C. and 75% relative humidity. In some cases, the oral product 110 can have a conversion of less than 1.3% of nicotine into nicotine-N-oxide after aging the oral product 110 for 10 weeks at 40° C. and 75% relative humidity. In some cases, the oral product 110 can have a conversion of less than 1.2% of nicotine into nicotine-N-oxide after aging the oral product 110 for 10 weeks at 40° C. and 75% relative humidity. In some cases, the oral product 110 can have a conversion of less than 1.8% of nicotine into nicotine-N-oxide after aging the oral product 110 for 12 weeks at 40° C. and 75% relative humidity. In some cases, the oral product 110 can have a conversion of less than 1.7% of nicotine into nicotine-N-oxide after aging the oral product 110 for 12 weeks at 40° C. and 75% relative humidity. In some cases, the oral product 110 can have a conversion of less than 1.5% of nicotine into nicotine-N-oxide after aging the oral product 110 for 12 weeks at 40° C. and 75% relative humidity. The presence of antioxidant may also reduce the formation of other tobacco derived impurities, such as Cotinine and myosime.

Sweeteners

A variety of synthetic and/or natural sweeteners can be used as additives in the oral product 110. Suitable natural sweeteners include sugars, for example, monosaccharides, disaccharides, and/or polysaccharide sugars, and/or mixtures of two or more sugars. According to some embodiments, the oral product 110 includes one or more of the following: sucrose or table sugar; honey or a mixture of low molecular weight sugars not including sucrose; glucose or grape sugar or corn sugar or dextrose; molasses; corn sweetener; corn syrup or glucose syrup; fructose or fruit sugar; lactose or milk sugar; maltose or malt sugar or maltobiose; sorghum syrup; mannitol or manna sugar; sorbitol or d-sorbite or d-sobitol; fruit juice concentrate; and/or mixtures or blends of one or more of these ingredients. The oral product 110 can also include non-nutritive sweeteners. Suitable non-nutritive sweeteners include: stevia, saccharin; Aspartame; sucralose; or acesulfame potassium.

Flavorants

The oral product 110 can optionally include one or more flavorants. The flavorants can be natural or artificial. For example, suitable flavorants include wintergreen, cherry and berry type flavorants, various liqueurs and liquors (such as Dramboui, bourbon, scotch, and whiskey) spearmint, peppermint, lavender, cinnamon, cardamon, *apium* graveolents, clove, cascarilla, nutmeg, sandalwood, bergamot, geranium, honey essence, rose oil, vanilla, lemon oil, orange oil, Japanese mint, *cassia*, caraway, cognac, jasmin, chamomile, menthol, ylang ylang, sage, fennel, pimenta, ginger, anise, coriander, coffee, liquorish, and mint oils from a species of the genus *Mentha*, and encapsulated flavors. Mint oils useful in particular embodiments of the oral product 110 include spearmint and peppermint. Synthetic flavorants can also be used. In certain embodiments, a combination of flavorants can be combined to imitate a tobacco flavor. The particular combination of flavorants can be selected from the flavorants that are generally recognized as safe ("GRAS") in a particular country, such as the United States. Flavorants can also be included in the oral product as encapsulated flavorants.

In some embodiments, the flavorants in the oral product 110 are limited to less than 20 weight percent in sum. In some embodiments, the flavorants in the oral product 110 are limited to be less than 10 weight percent in sum. For example, certain flavorants can be included in the oral product 110 in amounts of about 1 weight percent to 5 weight percent.

Other Additives

The oral product 110 may optionally include other additives. For example, these additives can include non-nicotine alkaloids (e.g., caffeine), dietary minerals, vitamins, dietary supplements, therapeutic agents, and fillers.

According to certain embodiments, the oral product 110 includes caffeine. A caffeinated oral product can include synthetic caffeine and/or coffee-bean-extracted caffeine. In some embodiments, a caffeinated oral product includes coffee flavors and sweeteners. According to some embodiments, an oral product can include between 10 and 200 mg of caffeine. Oral products 110 can also include vitamins, dietary minerals, other dietary supplements, and/or therapeutic agents. For example, suitable vitamins include vitamins A, B1, B2, B6, C, D2, D3, E, F, K, and P. For example, an oral product 110 can include C-vitamins with or without the presence of nicotine or caffeine. Suitable dietary minerals include calcium (as carbonate, citrate, etc.) or magnesium (as oxide, etc.), chromium (usually as picolinate), and iron (as bis-glycinate). One or more dietary minerals could be included in an oral product with or without the use of other additives. Other dietary supplements and/or therapeutic agents can also be included as additives.

The oral product 110 can also include fillers such as starch, di-calcium phosphate, lactose, sorbitol, mannitol, and microcrystalline cellulose, calcium carbonate, dicalcium phosphate, calcium sulfate, clays, silica, glass particles, sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides), stabilizers (e.g., ascorbic acid and monosterol citrate, BHT, or BHA), disintegrating agents (e.g., starch, sodium starch glycolate, cross caramellose, cross linked PVP), pH stabilizers, or preservatives. In some embodiments, the amount of filler in the oral product 110 is limited to less than 10 weight percent in sum. In some embodiments, the amount of filler in the oral product 110 is limited to be less than 5 weight percent in sum. In some embodiments, the fillers are mouth stable. In other embodiments, the fillers can dissolve or disintegrate during use and thus result in an oral product that becomes more pliable during use.

Fibers

The oral product can include fibers within the mouth-soluble polymer matrix. The fibers can be mixed with the mouth-soluble polymer prior to or during an extrusion process. The fibers provide passages in the mouth-soluble polymer matrix, which can permit certain additives within the mouth-soluble polymer matrix to be released into an oral cavity when the oral product is received in an oral cavity and exposed to saliva. The additives can be absorbed in fiber-polymer matrix and/or form pockets within the mouth-soluble polymer matrix, which can be accessed via the fibers. The oral product 110 can also include channels formed adjacent the fibers. In some embodiments, the fibers are hydrophilic such that water-soluble additives can be wicked by the fibers. In some embodiments, the fibers can dissolve to leave channels.

The fibers can be cellulosic fibers. The cellulosic fibers can be derived from plant tissue. Suitable sources for cellulosic fibers include wood pulp, cotton, sugar beets, bran, citrus pulp fiber, switch grass and other grasses, *Salix* (willow), tea, and *Populus* (poplar). In some embodiments, the cellulosic fibers can be plant tissue comprising various natural flavors, sweeteners, or active ingredients. In some embodiments, the oral product 110 can include nicotine as an additive (optionally with additional sweeteners and flavors) and non-tobacco cellulosic fiber, and thus be substantially free of tobacco plant tissue.

In some alternative embodiments, the cellulosic fiber can be derived from tobacco plant tissue. For example, the oral product can include exhausted tobacco fibers within the mouth-soluble polymer matrix. As used herein, "exhausted tobacco plant tissue" is tobacco plant tissue that has been treated to remove at least 10 percent of the tobacco's nicotine. In some embodiments, the exhausted tobacco plant tissue can be treated to remove at least 25%, 40%, 50%, 60%, 70%, 75%, 80%, 85%, 90%, or 95% of the nicotine. For example, the tobacco plant tissue can be washed with water or another solvent to remove the nicotine.

The cellulosic fibers can have a variety of dimensions. The dimensions of the fibers (in addition to the amount) can impact the release characteristics of the additives. For example, cellulosic fibers can be hydrophilic, thus water soluble additives (e.g., nicotine) can preferentially be absorbed in fiber-polymer matrix. In certain embodiments, the cellulosic fiber can be processed to have an average fiber size of less than 200 micrometers. In particular embodiments, the fibers are between 75 and 125 micrometers. In other embodiments, the fibers are processed to have a size of 75 micrometers or less. Exemplary average sizes are in the range of 1 to 1000 .mu.m, e.g., about 800, 500, 250, 100, 80, 75, 50, 25, 20, 15, 10, 8, 6, 5, 3, 2, or 1 micrometers or less.

The oral product 110 can also include soluble fibers. The soluble fibers can be adapted to dissolve faster than the mouth-soluble polymer matrix when exposed to saliva when the oral product 110 is received in an oral cavity. In some embodiments, the soluble fiber can include maltodextrin. The maltodextrin can be derived from corn. For example, Soluble Dietary Fiber can be included in an oral product 110. Soluble fibers can be used alone or with cellulosic fibers to provide channels for additives to be released from the oral product 110. As the soluble fibers dissolve, the oral product 110 can become more flexible and the additional channels can open up to permit the release of additional additive deposits. Suitable soluble fibers include *psyllium* fibers. In other embodiments, the fibers can be partially soluble. For example, sugar beet fibers can partially dissolve during use.

In some embodiments, an oral product 110 can include a combination of soluble and insoluble fibers. The ratio of soluble to insoluble fiber can impact the softness of texture of the oral product 110. The ratio of soluble to insoluble fiber can also impact the compressibility of the oral product 110. In some embodiments, a ratio of soluble to insoluble fiber is between 1:60 and 60:1. In some embodiments, the ratio of soluble to insoluble fiber is greater than 1:50, greater than 1:40, greater than 1:30, greater than 1:20, greater than 1:10, or greater than 1:5. In some embodiments, the ratio of soluble to insoluble fiber is less than 1:1, less than 1:2, less than 1:5, less than 1:10, less than 1:20, or less that 1:30. In some case, an oral product having a mixture of soluble and insoluble fibers can have a percentage of compression @ 250 N of between 60 percent and 98 percent, between 65 percent and 95 percent, between 70 percent and 90 percent, or between 80 and 89 percent.

The inclusion of soluble fiber can increase the compressibility of the oral product, which can also be perceived as a softer mouth feel by an adult tobacco consumer. The soluble and the insoluble exhausted-tobacco fiber can be pre-mixed and added into the process via a single feeder. Separate fiber feeders can also be used to produce a desired ratio. In some cases, the inclusion of about 1-3% of soluble fiber and about 25-35% insoluble fiber can result in a Compression @ 250N of between 70% and 90%.

Plasticizers

The oral product 110 can also include one or more plasticizers. Plasticizers can soften the final oral product and thus increase its flexibility. Plasticizers work by embedding themselves between the chains of polymers, spacing them apart (increasing the "free volume"), and thus significantly lowering the glass transition temperature for the plastic and making it softer. Suitable plasticizers include propylene glycol, glycerin, vegetable oil, and medium chain triglycerides. In some embodiments, the plasticizer can include phthalates. Esters of polycarboxylic acids with linear or branched aliphatic alcohols of moderate chain length can also be used as plasticizers. Moreover, plasticizers can facilitate the extrusion processes described below. In some embodiments, the oral product 110 can include up to 20 weight percent plasticizer. In some embodiments, the oral product 110 includes between 0.5 and 10 weight percent plasticizer, the oral product 110 can include between 1 and 8 weight percent plasticizer, or between 2 and 4 weight percent plasticizer. For example, an oral product comprising a polyurethane polymer matrix and include about 3 to 6.5 weight percent of propylene glycol.

Molding Processes

The oral product 110 can be produced by extruding a mouth-soluble polymer (e.g., starch) with fibers (e.g., cellulosic fiber) and/or additive (e.g., nicotine) to form a rod of a mouth-soluble polymer matrix including fibers and/or additives. The rod is cut into individual oral products 110.

In addition to extrusion, there are many methods for making and shaping the oral products. In some embodiments, extruded and cut pieces can be introduced into a compression mold to form a final oral product shape. In other embodiments, the oral product 110 can be injection molded, compression molded, or injection-compression molded. Blocks of polymer, fiber, and/or additive can also be formed and machined into a desired shape.

A coated stick oral product, such as shown in FIG. 4, can be produced by forming a slurry of the mouth-soluble polymer, the cellulosic fibers, nicotine, and one or more additional additives; applying the slurry to the stick, and drying the coating. The slurry can be made by mixing the materials together with one or more solvents (e.g., water, ethanol). The slurry can be applied to the stick by dipping the stick into the slurry, either by hand or by machine. A dipping procedure can include multiple dips with partial drying steps in between. One or more layers can be applied to obtain a coating having a thickness of between 0.1 mm and 2 mm on the stick. The coated stick can then be dried in a curing chamber to obtain a desired dryness. A plurality of coated sticks can be packaged together in a rectangular package.

Other Embodiments

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. An oral product comprising:

a mouth-soluble polymer matrix having a plurality of pores;

non-tobacco cellulosic fibers embedded in the mouth-soluble polymer matrix; and nicotine or a nicotine derivative in pores of the mouth-soluble polymer matrix, wherein the non-tobacco cellulosic fibers are configured to provide access to the nicotine or nicotine derivative, and the oral product is substantially free of tobacco plant tissue, wherein the oral product has a springiness ranging from 75% to 90%.

2. The oral product of claim 1, further comprising:

soluble fibers embedded in the mouth-soluble polymer matrix.

3. The oral product of claim 1, further comprising:

a plasticizer dispersed in the mouth-soluble polymer matrix.

4. The oral product of claim 3, wherein the plasticizer includes propylene glycol, glycerin, vegetable oil, triglycerides, or any combination thereof.

5. The oral product of claim 1, further comprising:

a sweetener dispersed in the mouth-soluble polymer matrix.

6. The oral product of claim 5, wherein the sweetener includes saccharine, sucralose, aspartame, acesulfame potassium, or any combination thereof.

7. The oral product of claim 1, further comprising:

a flavorant dispersed in the mouth-soluble polymer matrix.

8. The oral product of claim 7, wherein the flavorant includes licorice, wintergreen, cherry and berry type flavorants, Drambuie, bourbon, scotch, whiskey, spearmint, peppermint, lavender, cinnamon, cardamon, *apium graveolens*, clove, cascarilla, nutmeg, sandalwood, bergamot, geranium, honey essence, rose oil, vanilla, lemon oil, orange oil, Japanese mint, *cassia*, caraway, cognac, jasmine, chamomile, menthol, ylang-ylang, sage, fennel, pimenta, ginger, anise, coriander, coffee, mint oils from a species of the genus *Mentha*, or any combination thereof.

9. The oral product of claim 1, wherein the mouth-soluble polymer matrix includes a cellulosic polymer, carboxymethyl cellulose (CMC), hydroxypropyl cellulose (HPC), hydroxyethyl cellulose (HEC), hydroxypropyl methyl cellulose (HPMC), methyl cellulose (MC), a natural polymer, a starch, a modified starch, konjac, collagen, inulin, a soy protein, a whey protein, casein, wheat gluten, a seaweed-derived polymer, a carrageenan, kappa, iota, lambda, an alginate, propylene glycol alginate, a microbial-derived polymer, xanthan, dextran, pullulan, curdlan, gellan, an extract, locust bean gum, guar gum, tara gum, gum tragacanth, pectin, a low methoxy pectin, an amidated pectin, agar, zein, karaya, gelatin, *psyllium* seed, chitin, and chitosan, an exudate, gum acacia, a shellac, a synthetic polymer, polyvinyl pyrrolidone, polyethylene oxide, polyvinyl alcohol, or any combination thereof.

10. The oral product of claim 1, wherein the oral product is shield shaped.

* * * * *